US007040039B1

(12) United States Patent
Stein et al.

(10) Patent No.: US 7,040,039 B1
(45) Date of Patent: May 9, 2006

(54) CLOTHES DRYER WITH LINT DETECTOR

(76) Inventors: Richard Stein, 23097 Lowridge Pl., Saugus, CA (US) 91390; David Whitehead, 402 Avenue G. #25, Redondo Beach, CA (US) 90277; Richard Scholl, 22612 W. Palm Ct., Saugus, CA (US) 93109; Mark Sumner, 23095 Lowridge Pl., Saugus, CA (US) 93109

( * ) Notice: Subject to any disclaimer, the term of this patent is extended or adjusted under 35 U.S.C. 154(b) by 0 days.

(21) Appl. No.: 11/021,833

(22) Filed: Dec. 23, 2004

(51) Int. Cl.
*F26B 19/00* (2006.01)

(52) U.S. Cl. ..... 34/529; 34/595

(58) Field of Classification Search ..... 34/529, 34/544, 595, 606; 73/861.5
See application file for complete search history.

(56) References Cited

U.S. PATENT DOCUMENTS

| | | | | |
|---|---|---|---|---|
| 3,639,998 | A | 2/1972 | Mason | |
| 3,718,982 | A | 3/1973 | Deaton | |
| 4,689,896 | A | 9/1987 | Narang | |
| 4,700,492 | A | 10/1987 | Werner et al. | |
| 5,097,606 | A | 3/1992 | Harmelink et al. | |
| 5,396,715 | A | 3/1995 | Smith | |
| 5,775,041 | A * | 7/1998 | Tull et al. | 52/455 |
| 5,822,883 | A | 10/1998 | Horwitz | |
| 6,725,732 | B1 | 4/2004 | Stein | |
| 2004/0159008 | A1 * | 8/2004 | Harpenau | 34/595 |

OTHER PUBLICATIONS

Basic Information Package: An Information Summary, Invention "Safety Feature Dryer"; 2002 Invention Submission Corporation.
Engineer's Report of Dryer Warnings and Lint Fire, Ronald D. Schaible, CHFP, CSP, P.E., Mar. 6, 2001.
Fairchild Semiconductor Phototransistor Reflective Object Sensor QRB1113 QRB1114 © 2002.
http://www.msnbc.com/news/554017.asp MSNBC Dateline NBC: Is your dryer a fire hazard? What you need to know about preventing fires: Dateline NBC's Lea Thompson reports on the fire hazards posed to clothes dryers, Oct. 2002.
http://www.statefarm.com/consumer/vhouse/articles/dryer.htm Nov. 2000 StateFarm.com: Clothes Dryers—A Fire Hazard to Know About: Clothes Dryers Fire Statistics, What Causes Clothes Dryer Fires?, What Can a Homeowner Do?.
Texas Instruments SN5472, SN7472 AND-gated J-K Master-Slave Flip-Flops with Preset and Clear © 1988.

* cited by examiner

*Primary Examiner*—S. Gravini
(74) *Attorney, Agent, or Firm*—Greenberg Traurig LLP; Pablo Tapia

(57) ABSTRACT

A device and method for detecting lint in a clothes dryer are disclosed. A lint detector is positioned within the clothes dryer. A light source is also positioned within the clothes dryer. The lint detector has a surface that receives light emitted by the light source. Further, the lint detector has a photocell that receives light reflected from the surface if lint covers the surface. A determination is made as to whether a threshold amount of light has been received. An indication such as the activation of a warning light can be provided if the threshold amount of light is received. Another response is shutting the clothes dryer down.

33 Claims, 15 Drawing Sheets

CLOTHES DRYER WITH LINT DETECTOR

BACKGROUND

1. Field of the Disclosure

This disclosure generally relates to safety mechanisms for household appliances and other electrical devices. In particular, this disclosure relates to safety mechanisms that detect the presence of lint in clothes dryers.

2. General Background

A clothes dryer inevitably produces particles of lint and fibers that accumulate in many areas of the clothes dryer. A lint filter positioned in the air vent within the clothes dryer captures a quantity of these lint particles. However, some lint unavoidably permeates the lint filter to unreachable areas of the clothes dryer and accumulates with the passage of time. Lint can also permeate crevasses between the chamber and the housing of the clothes dryer.

Unbeknownst to many users, the accumulation of lint in clothes dryers poses a serious fire hazard. Common fire hazards in clothes dryers are generally caused by the accumulation of lint in the exhaust duct, or filter or accumulation of lint in the vicinity of the heating element. Because lint is highly flammable, proximity to the motor or the heating element of a clothes dryer can ignite the lint very rapidly and propagate the fire to the rest of the premises. Fires initiated by lint accumulation have caused hundreds of injuries and many human fatalities. According to the U.S. Consumer Product Safety Commission, there are an estimated annual 15,500 fires, 310 injuries, and 10 deaths associated with clothes dryers.

Unfortunately, the lint fire hazard has been exacerbated by other factors. Users of clothes dryers tend to leave the appliance turned on when they leave the house. Further, poor filter maintenance may increase the presence of lint within the clothes dryer. Even when lint filters are cleaned, sometimes lint particles are airborne and later settle in other areas of the clothes dryer.

SUMMARY

In one aspect, there is a clothes dryer that has a chamber that receives clothing items. A fan circulates air through the chamber. A heating element heats the air being circulated by the fan. An input console receives an input from a user to initiate operation of the clothes dryer. A controller activates the heating element upon receiving the input from the user of the clothes dryer. A light source is positioned within the clothes dryer. Further, a lint detector is positioned within the clothes dryer. The lint detector has a surface that receives light emitted by the light source. The lint detector also has a photocell that receives light reflected from the surface if lint covers the surface.

In one aspect, an indicator warns that lint is present within the clothes dryer. The indicator can be a warning light. Further, the indicator can be an audio speaker that provides an audio signal. In another aspect, the clothes dryer is automatically shut down if lint is present within the clothes dryer.

In one aspect, the light source is a light emitting diode. In another aspect, the light source is an incandescent bulb. In yet another aspect, the light source emits a laser beam. In one aspect, the light source emits an infrared light.

In another aspect, there is a method of detecting lint in a clothes dryer. Light is received through a surface within the clothes dryer. The light is received at a photocell if the light is reflected off the surface when lint covers the surface. An indication is then provided that lint is present within the clothes dryer. In one aspect, the surface is transparent. In another aspect, the surface is non-reflective.

In another aspect, there is a lint detector positioned within a clothes dryer. Light travels through a surface. The light is emitted by a light source positioned within the clothes dryer. A photocell that receives the light reflected from the surface if lint covers the surface.

In one aspect, the lint detector has a warning light that activates if a threshold amount of light is received. In another aspect, the lint detector has an audio speaker that provides an audio signal if the threshold amount of light is received. In yet another aspect, the lint detector has emits an electrical output that indicates if the threshold amount of light is received. In another aspect, the clothes dryer is automatically shut down if a threshold amount of light is received.

In one aspect, there is a clothes dryer that has a lint detector. A light source and a lint detector are positioned within the clothes dryer. The lint detector has a photocell that receives light from the light source. The lint detector determines the presence of lint upon the photocell not receiving a predetermined amount of light. In another aspect, the lint detector determines the presence of lint upon the photocell receiving insufficient amount of light in comparison with the predetermined amount of light.

In one aspect, the photocell does not receive the predetermined amount of light because lint covers the photocell. In another aspect, the photocell does not receive the predetermined amount of light because lint covers the light source. In another aspect, the photocell does not receive the predetermined amount of light because lint interrupts a path of the light from the light source to the photocell.

In another aspect, there is a method of detecting lint in a clothes dryer. A predetermined amount of light is received at a photocell within the clothes dryer. It is then detected if the predetermined amount of light differs by a threshold from an amount of light actually received at the photocell. A determination is made as to whether the difference between the predetermined amount of light and the amount of light actually received at the photocell surpasses the threshold. An indication that lint is present within the clothes dryer is provided if the threshold is surpassed.

In another aspect, a lint detector is positioned within a clothes dryer. A light source is positioned within the clothes dryer and emits a predetermined amount of light. Further, a photocell receives the predetermined amount of light from the light source. In addition, a threshold indicator indicates the presence of lint if the photocell does not receive the predetermined amount of light. In another aspect, the threshold indicator indicates the presence of lint if the photocell receives an insufficient amount of light in relation to the predetermined amount of light.

BRIEF DESCRIPTION OF THE DRAWINGS

By way of example, reference will now be made to the accompanying drawings.

DETAILED DESCRIPTION

A method and a system are disclosed for detecting the presence of lint in a clothes dryer. In one embodiment, lint is detected in areas of the clothes dryer other than in the lint filter. For instance, lint particles can move through the holes in the lint filter and can accumulate in other parts of the clothes dryer. Further, lint particles can enter these other parts by moving between crevasses of the tumbler of the clothes dryer and the housing of the clothes dryer. At first, these lint particles may not be of a significant enough quality or quantity to pose a problem. However, as time goes on, more lint particles accumulate and a threshold at which safety becomes a concern is reached.

Figure 1A:
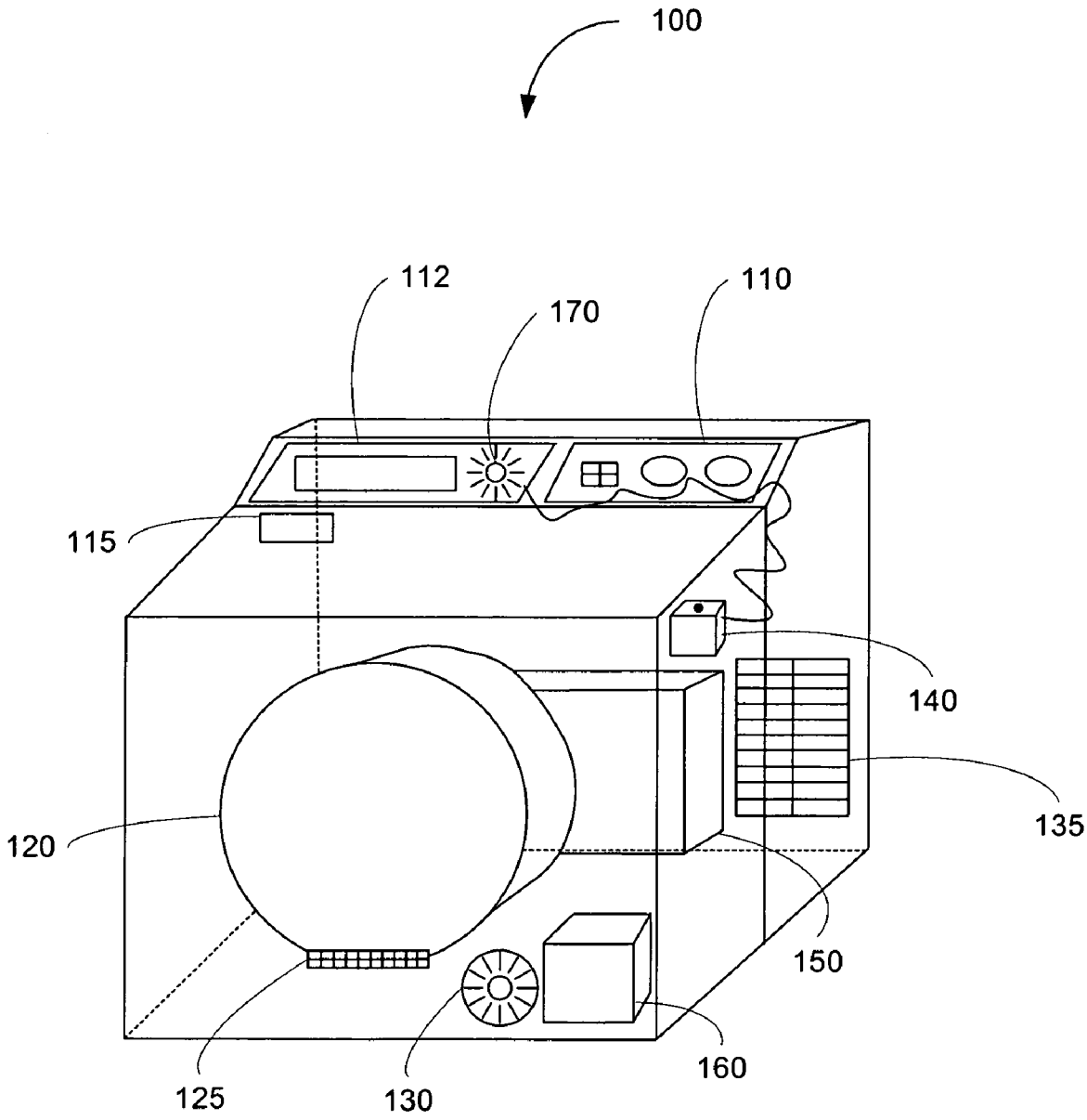
FIG. 1A illustrates a clothes dryer with a lint detector.

FIG. 1A illustrates a clothes dryer 100 that has a lint detector 140. The lint detector 140 detects lint 290 (See FIG. 2B). In one embodiment, the clothes dryer 100, as shown in FIG. 1A, has an input console 110, a display panel 112, and a controller 115. The input console 110 receives manual input from a user. The input console 110 can include rotating knobs, buttons, touch screens, voice recognition devices, capacitance switches, etc. In one embodiment, the display panel 112 displays data regarding the status of the drying cycle to the user. In another embodiment, the display panel 112 displays the remaining time of the drying cycles. In another embodiment, the display panel 112 includes at least one warning light. In another embodiment, the controller 115 is connected to the input console 110. In another embodiment, the controller 115 is connected to the display panel 112. In one embodiment, the display panel 112 is a liquid crystal display. In another embodiment, the display panel 112 is connected to the input console 110.

In one embodiment, the controller 115 is an electrical circuit that receives electrical signals, and based on logic, produces electrical outputs. In another embodiment, the controller 115 is a microprocessor. In one embodiment, the controller 115 provides electrical signals to a motor 160, a chamber 120, a heating element 150, or a lint detector 140. In another embodiment, the controller 115 receives electrical signals from a motor 160, a chamber 120, a heating element 150, or a lint detector 140.

The clothes dryer 100 also includes a chamber 120, a fan 130 and lint screen 125. The motor 160 rotates the chamber 120 and the fan 130. The fan 130 draws air into the body of the clothes dryer 100 by a suction mechanism. The air is passed through the heating element 150 and into the chamber 120. The air exits the chamber 120 through a lint screen 125. The air then travels through the fan 130 and is expelled through the exhaust vent 135. As the air circulates through the body of the clothes dryer 100, lint particles travel in the circulating air. Lint deposits in the lint screen 135 and other parts of the clothes dryer 100 such as the heating element 150, the motor 160, the chamber 120, the lint screen 125, the fan 130, the exhaust vent 135, etc.

The lint detector 140 can be positioned at any location in the clothes dryer 100. When the lint detector 140 detects lint, it sends an electrical signal to the controller 115. Upon receiving the signal, the controller 115 can, among other things, warn a user or shut down the clothes dryer 100. In one embodiment, the controller 115 warns the user of the presence of lint by turning on a warning light 170. In one embodiment, the controller 115 warns the user of the presence of lint by emitting a sound. In another embodiment, the controller 115 shuts down the motor 160. In yet another embodiment, the controller 115 shuts down the heating element 150. In another embodiment, the controller 115 turns off the clothes dryer 100. In yet another embodiment, the controller 115 is equipped with a communications module that allows the controller 115 to connect to a communications network to warn a user that is connected to the communications network.

The lint detector 140 can be positioned in places within the clothes dryer 100 where lint or dust is most likely to settle and become a fire hazard. For example, the lint detector 140 can be positioned in proximity to the heating element 150 or in proximity to the motor 160. In another embodiment, the lint detector 140 can be positioned in locations that are distant from the heating element 150 or the motor 160. Heat that is produced from the heating element 150 travels throughout the clothes dryer 100 and ignites the highly flammable lint particles even at a remote position.

Figure 1B:
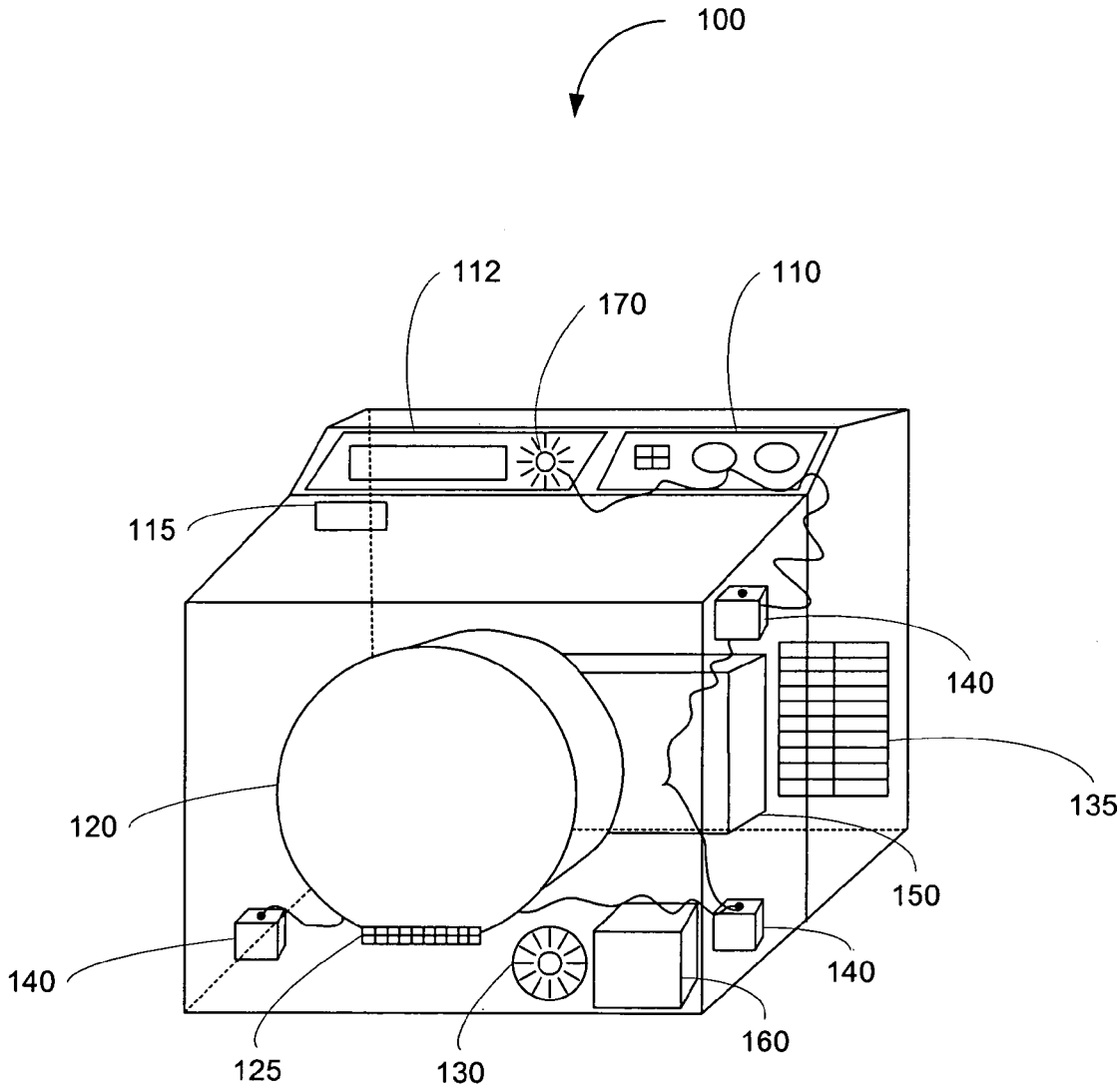
FIG. 1B illustrates the clothes dryer shown in FIG. 1A with a plurality of interconnected lint detectors.

FIG. 1B illustrates the clothes dryer 100 as illustrated in FIG. 1A having a plurality of lint detectors 140. The lint detectors 140 can be placed in different areas of the clothes dryer 100. Each of the lint detectors 140 operates in conjunction with the other components of the clothes dryer 100 in a similar fashion to the single lint detector 140 shown in FIG. 1A.

In one embodiment, as illustrated in FIG. 1B, the lint detectors 140 are electrically connected. If one of the lint detectors 140 detects lint, the others will receive an electrical signal indicating that there is lint in the clothes dryer 100. The electrical signal is ultimately passed to the controller 115. The controller 115 takes action such as turning on a warning light in the display panel 112. If the controller 115 receives a subsequent indication from another lint detector 140, the controller 115 can ignore that signal because the warning light is already on and is being displayed in the display panel 112.

Figure 1C:
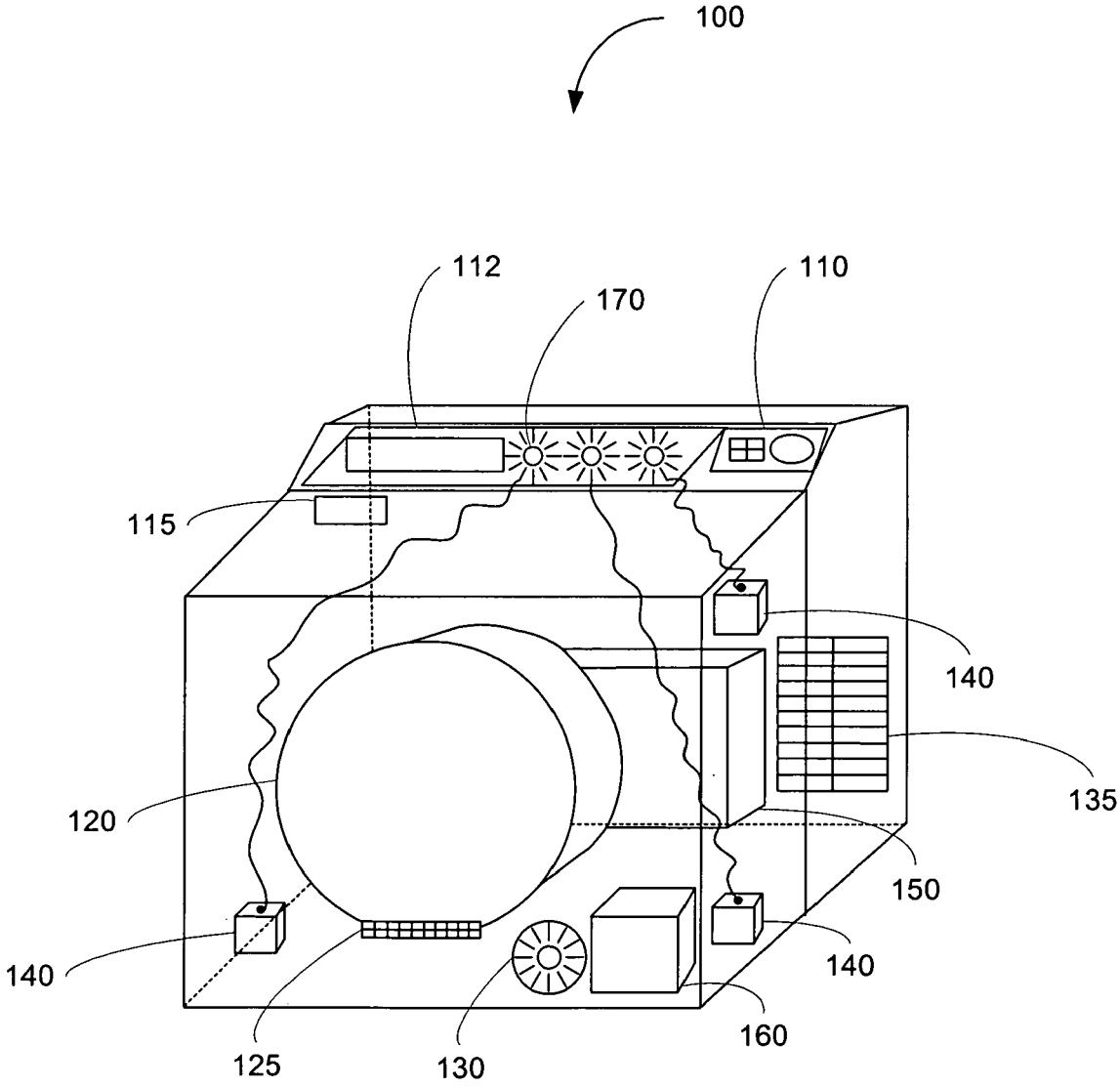
FIG. 1C illustrates the clothes dryer illustrated in FIG. 1A with a plurality of independent lint detectors.

FIG. 1C illustrates the clothes dryer 100 as illustrated in FIG. 1B having a plurality of lint detectors 140. In one embodiment, the lint detectors 140 are not connected to each other, but have separate and direct electrical connections to the controller 115. The controller 115 receives the electrical signal of a lint detector 140 indicating that there is lint in the clothes dryer 100. The controller 115 takes action such as turning on a warning light in the display panel 112. In one embodiment, the controller is connected to one warning light 170 on the display panel 112. Subsequent signals from another lint detector 140 are ignored. In another embodiment, the controller 115 is connected to separate warning lights 170 corresponding to each lint detector 140. In one embodiment, each warning light 170 is displayed with a label corresponding to the area of the clothes dryer 100 where the lint detector 140 is located. For instance, a lint detector 140 placed in proximity to the motor 160 would have an individual electrical connection to the warning light 170. The warning light 170 is connected to the controller 115 and appears next to a label "Lint near the motor." The lint detector 140 that is placed in proximity to the heating unit 150 would have an individual electrical connection to a light 170 in the controller 115 which is labeled "Lint near the heater." If the lint detector 140 near the heating unit 150 detects lint, the corresponding light 170 will turn on and the user of the clothes dryer 100 will know exactly the location in the clothes dryer 100 in which there is a significant accumulation of lint. If there are multiple areas in the clothes dryer where lint is accumulated, there will be multiple indicator lights 170 showing the corresponding areas where lint has been accumulated.

In another embodiment, the controller 115 is connected to multiple warning lights 170 which are color-coded with colors corresponding to the area of the clothes dryer 100 where the lint detector 140 is located. In another embodiment, the controller 115 is connected to an electrical display that can display text messages showing the area of the clothes dryer 100 where the lint detector 140 is located.

Figure 1D:
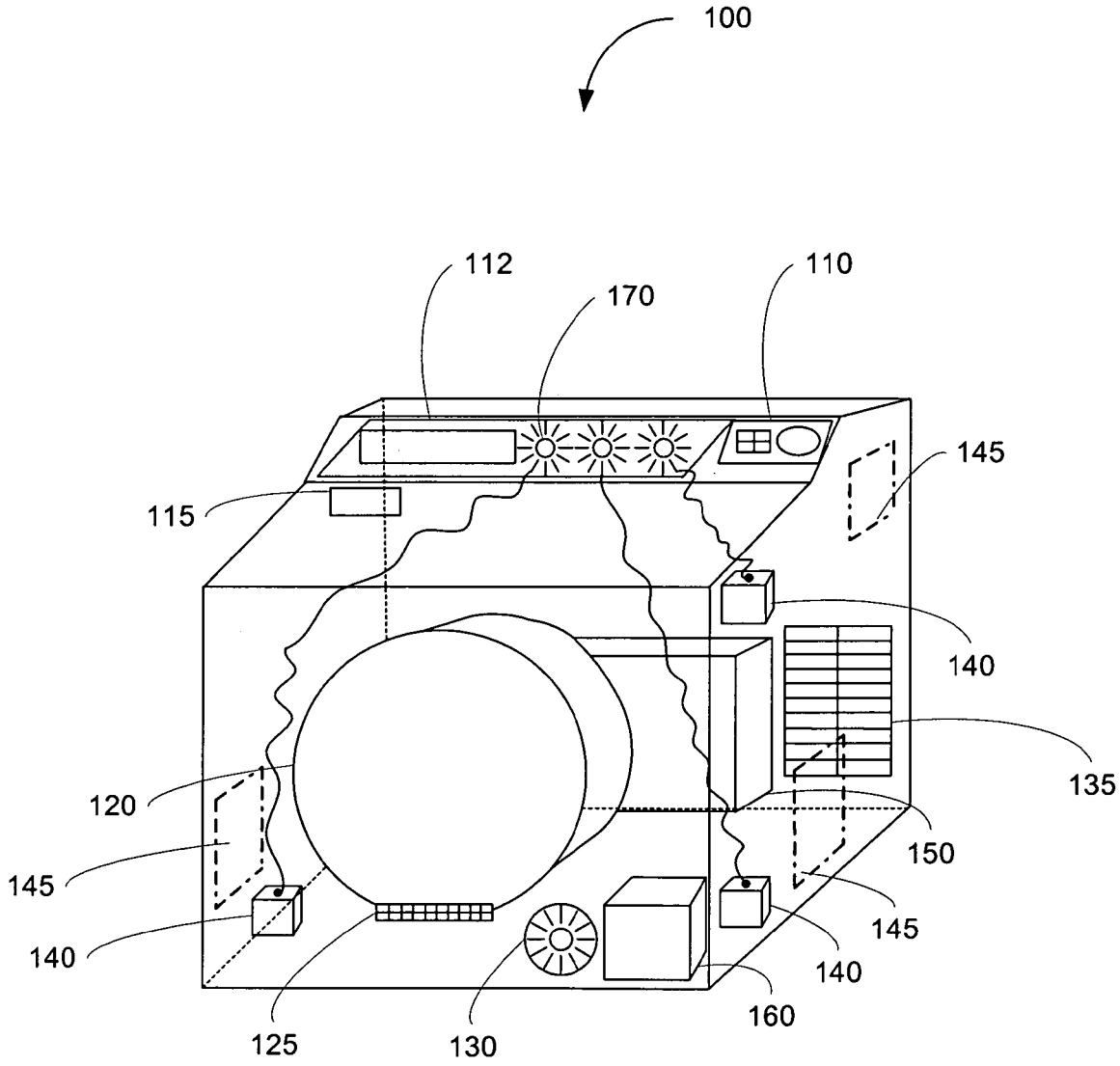
FIG. 1D illustrates the clothes dryer illustrated in FIG. 1A with a plurality of independent lint detectors and access doors.

FIG. 1D illustrates the clothes dryer 100 as illustrated in FIG. 1C having a plurality of lint detectors 140. In one embodiment, access doors 145 in the clothes dryer 100 can be provided for easy access in the area where the lint detectors 140 are positioned. In one embodiment, the access doors 145 are labeled with the element of the clothes dryer 100 that is near the door. In another embodiment, the access doors 145 are painted with the color corresponding to the color of the warning light 170. In another embodiment, the access doors 145 are numbered. The access doors 145 can provide access to clean up a specific area in the clothes dryer 100. The access doors can also be used for replacing the lint detector 140 with a new one. In one embodiment, the clothes dryer 100 has a safety feature to cover the motor 160 or the heating element 150 so that the user is insulated from danger of being in direct contact with the motor or 160 the heating element 150.

In another embodiment, where the lint detectors 140 have individual connections to the controller 115, the controller 115 can have specific circuitry to take a particular action depending on which lint detector 140 indicates the accumulation of lint. For example, if the lint detector 140 that is near the chamber 120 sends an electrical signal indicating the presence of lint, the controller 115 can turn on the light 170 indicating the presence of lint near the chamber 120. However, if the controller 115 receives an electrical signal from a lint detector 140 that is near the motor 160, the controller 115 can turn on the warning light 170 and turn off the motor 160.

Figure 2A:
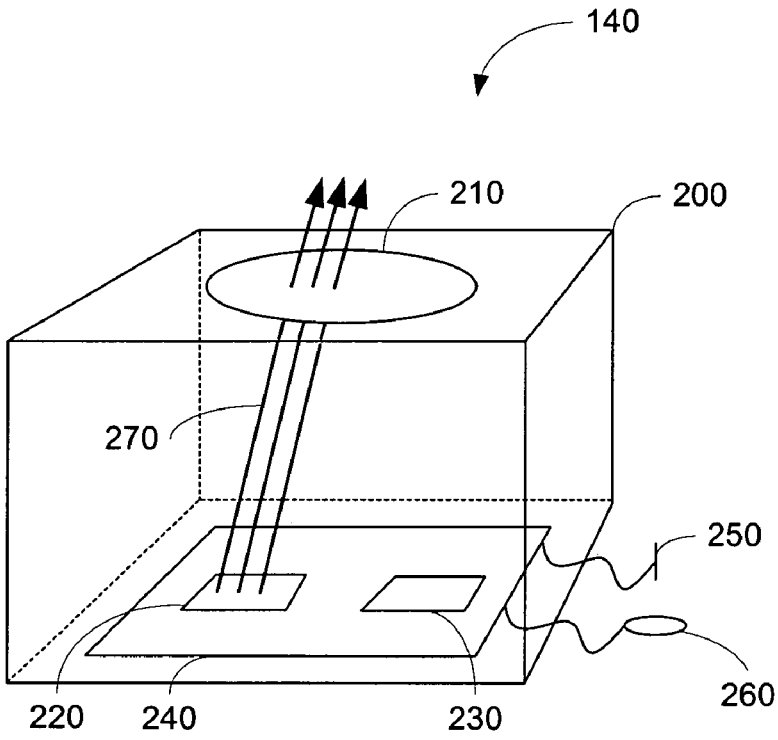
FIG. 2A illustrates an optical lint detector that detects lint based on the amount of light reflected by the lint covering the non-reflective surface.

FIG. 2A illustrates an optical lint detector 140 that detects lint 290 based on the amount of light reflected by the lint 290 covering the non-reflective surface 210. In one embodiment, the optical lint detector 140 has a housing 200, having the non-reflective surface 210. In one embodiment, the non-reflective surface 210 is a transparent surface. Light would normally travel through the transparent surface. In another embodiment, a semi-reflective surface can be utilized instead of the non-reflective surface 210. The non-reflective surface 210 can be positioned in an opening in the housing 200. The housing 200 can be a cube, a cylinder, a parallelepiped, or any other geometrical shape.

In one embodiment, the non-reflective surface 210 is positioned in an opening in the top of the housing 200. As lint particles accumulate in areas of the clothes dryer 100 other than the lint filter, the lint particles fall onto the top of the non-reflective surface 210. In alternative embodiments, the non-reflective surface 210 can be positioned on one of the sides or on the bottom of the housing 200.

In one embodiment, a light source 220 focuses light 270 onto the non-reflective surface 210. In one embodiment, the light source is positioned within the lint detector within the clothes dryer. In another embodiment, the light source is positioned within the clothes dryer but not within the lint detector. Because the non-reflective surface 270 is non-reflective, the light 270 passes through the non-reflective surface 210 to the exterior of the housing 200. A photocell 230 is placed in a manner such that if the light 270 reflects off the non-reflective surface 210, the photocell 230 would receive the reflected light. Because the light 270 passes through the non-reflective surface 210 and is not reflected, the photocell 210 does not receive any reflected light. In another embodiment, if a semi-reflective surface is utilized instead of the non-reflective 210, the photocell 230 may receive a marginal amount of light 270.

The photocell 210 and the light source 220 are connected to a circuit board 240 which in turn connects to a power source 250 and a warning light 260. The warning light 260 turns on if the photocell 230 receives a threshold amount of light as to allow current to flow to the warning light 260. When the non-reflective surface 210 is completely non-reflective, the photocell 230 does not receive any reflected light. Therefore, no current passes to the warning light 260 and the warning light 260 remains off. If a semi-reflective is utilized instead of the non-reflective surface 210, and the marginal amount of light 270 received by the photocell 230 does not surpass the threshold amount, the current will not flow to the warning light 260.

In one embodiment, the warning light 260 is a light emitting diode. In another embodiment, the warning light 260 is an incandescent light. Furthermore, in one embodiment, the light source, 220 is a light emitting diode. In another embodiment, the light source 220 is an incandescent light. In another embodiment, the light source 220 can emit infrared light.

Figure 2B:
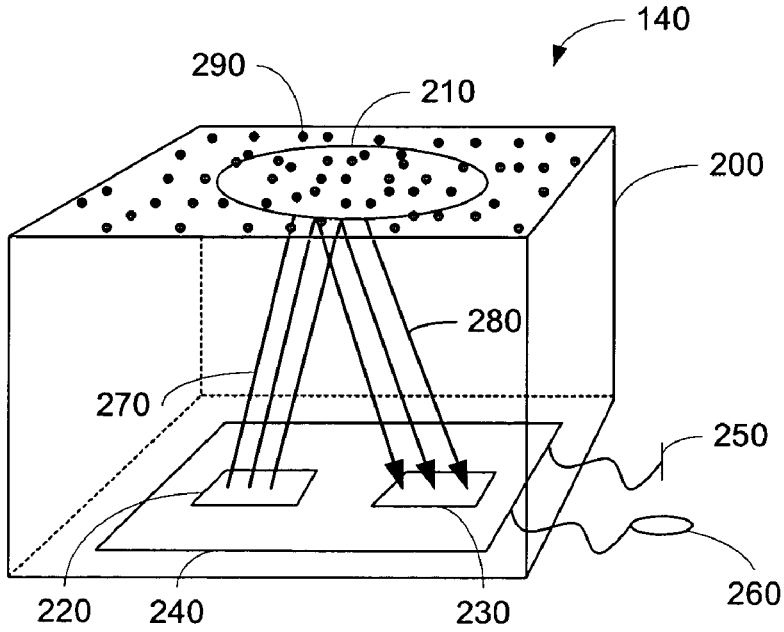
FIG. 2B illustrates an optical lint detector that detects the lint because the photocell receives the light.

FIG. 2B illustrates an optical lint detector 140 that detects the lint 290 because the photocell 230 receives the light 280. In FIG. 2B, the optical lint detector 140 detects lint 290 based on the amount of light reflected by the lint 290. A light source 220 focuses light 270 onto the non-reflective surface 210. In one embodiment, the non-reflective surface 270 is transparent and allows the light 270 to pass through the non-reflective surface 210 to the exterior of the housing 200. In another embodiment, the non-reflective surface 270 is not transparent and the light 270 is absorbed in the non-reflective surface 270. The photocell 230 is positioned to receive reflected light. When the light 270 hits the lint 290 reposing on the non-reflective surface 210, the light 270 is reflected off the lint 290. Consequently, the photocell 210 receives the reflected light 280. The warning light 260 turns on if the photocell 230 receives a threshold amount of light 280 that triggers the warning light 260 or any other warning indicator. Because the light 270 is reflected onto the photocell 230, the photocell 230 allows the current in the circuit board to flow to the warning light 260. As a result, the warning light 260 turns on. The warning light 260 remains on until the power source 250 is cut off.

Figure 3A:
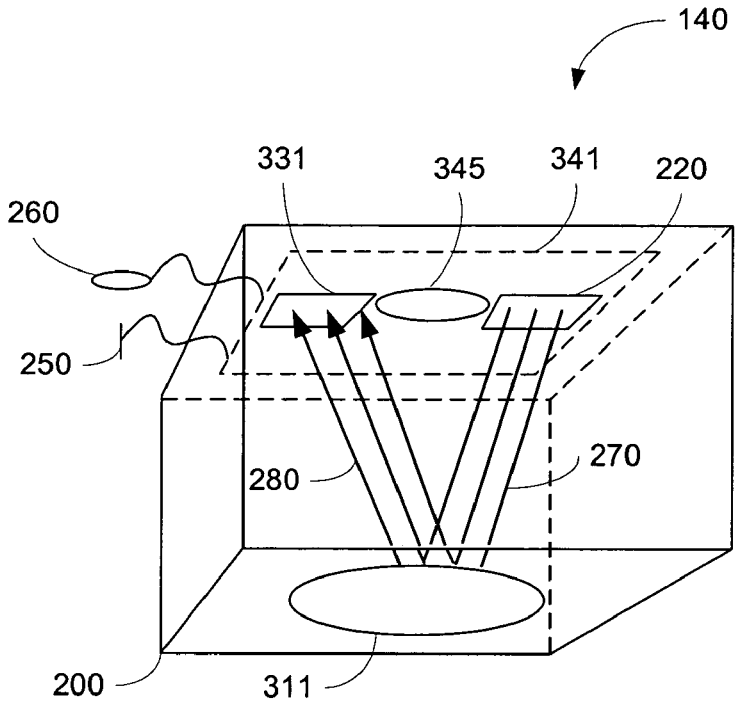
FIG. 3A illustrates an optical lint detector having a reflective surface.

FIG. 3A illustrates the optical lint detector 140 having a reflective surface 311. In one embodiment, the reflective surface is a mirror. The optical lint detector 140 detects lint 290 based on the amount of light obstructed by the presence of lint 290. In one embodiment, the optical lint detector 140 has a housing 200. In another embodiment, the optical lint detector 140 does not have a housing. The light source 220 focuses light 270 onto the reflective surface 211. A photocell 331 is placed in a manner that if the light 270 reflects off the reflective surface 311, the photocell 331 would receive the reflected light 280. The photocell 331 and light source 220 are connected to a circuit board 341 which in turn connects to the power source 260 and the warning light 250. The warning light 260 turns on if the photocell 331 stops to receive enough reflected light 280.

Figure 3B:
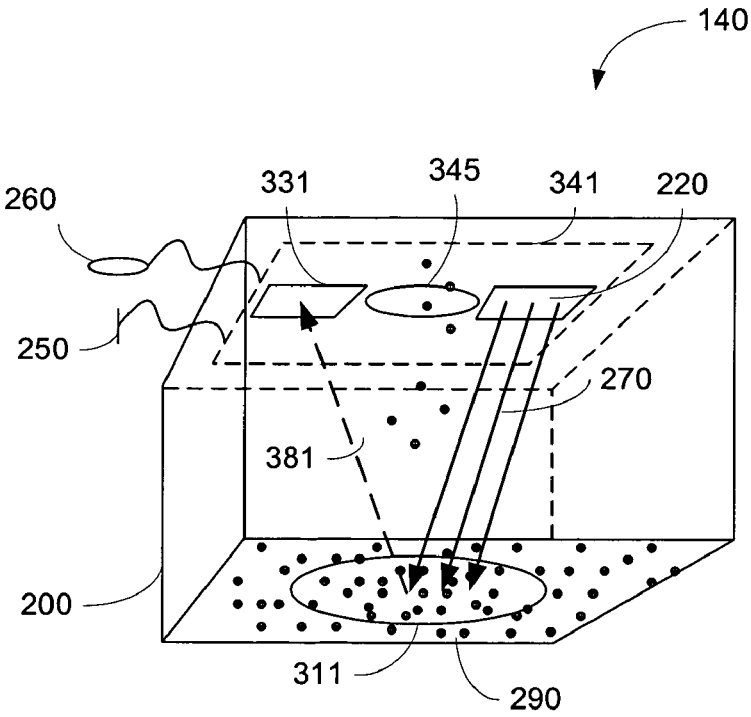
FIG. 3B illustrates light being obstructed from completely reflecting off the reflective surface.

FIG. 3B illustrates the light 270 being obstructed from completely reflecting off the reflective surface 311. The optical lint detector 140 detects lint 290 based on the amount of light obstructed by the presence of lint 290. As lint 290 falls through the opening 245, lint 290 settles in the housing and reposes on the reflective surface 311 gradually impeding reflection. When the light 270 hits the lint 290, the light 270 is not reflected with the same intensity as it was by the reflective surface 311. Consequently, the photocell 331 receives much less reflected light 281.

Depending on the amount of light 381 impinging on the photocell 331, the warning light 260 will turn on. The less light 381 impinging on the photocell, the more likely the warning light 260 will turn on. If at least a threshold amount of lint 290 lands on the reflective surface 311, enough reflected light 381 will be obstructed. As result, the amount of light 381 received by the photocell 331 will reduce to a threshold amount that will trigger the warning light 260 or any other warning indicator.

Figure 4:
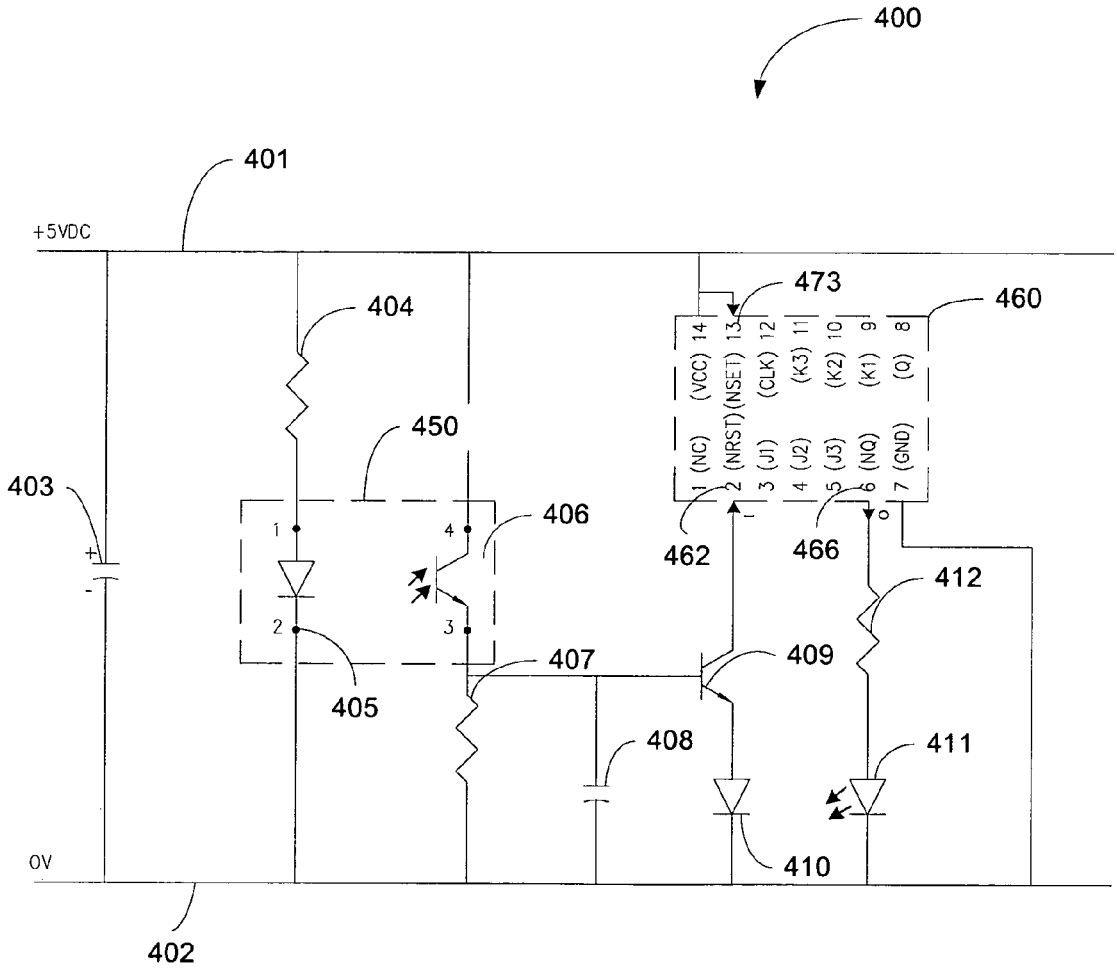
FIG. 4 illustrates a circuit of the circuit board of the optical lint detector.

FIG. 4 illustrates a circuit 400 of the circuit board 240 of the optical lint detector 140. A direct current (DC) power source of 5 volts (nominal) is supplied to the circuit on lines 401 and 402. Line 301 is connected to the 5-volt terminal of the DC power source and line 402 is connected to the 0-volt (common) terminal of the DC power source. A capacitor 403 is connected across the lines 401 and 402 to eliminate electrical transients upon application of power from the DC power source. Power up transients can cause erroneous switching of elements in the circuit 400.

A resistor 404 and a light emitting diode 405 are connected in series across the power source lines 401 and 402. The resistor 404 serves to limit the current to the diode 405. The resistance of resistor 404 may be varied to change the level of light emitted by the diode. In another embodiment, the diode 405 can be an incandescent light.

If there is lint 290 present on the lint detector 140, the phototransistor 406 receives the light reflected off the lint 290. The base current of phototransistor 406 is proportional to the level of light received. Therefore, as more light is received by the phototransistor 406, the collector-emitter resistance decreases allowing current to flow across resistor 407. Thus, a greater quantity of light received by phototransistor 406 produces a greater flow of current to resistor 407.

In another embodiment, a photoresistor is used instead of a phototransistor. The photoresistor receives the light. As the light received increases, the resistance lowers producing greater current flow to resistor 407.

The sensitivity of the lint detector 140 can be calibrated as a function of the voltage level at transistor 409. In one embodiment, a resistor 407, the transistor 409, and a diode 410 serve as a voltage level detection circuit. As current flow increases across resistor 407 the voltage seen at the base of transistor 409 increases. The transistor 409 switches between off and on depending on a threshold voltage level. The transistor 409 is in an off state when the voltage across resistor 407 is below the threshold level. The transistor 409 switches to an on state when the voltage across resistor 407 reaches or exceeds the threshold level. Diode 410 increases the threshold voltage level required at the base of transistor 409. In one embodiment, the threshold level is 1.2 volts. In another embodiment, the threshold level is 1.3 volts. The sensitivity of the circuit can be increased or decreased by increasing or decreasing the resistance across resistor 407. A capacitor 408 is connected across resistor 407 to eliminated electrical transients upon application of power from the dc power source which can cause erroneous switching of transistor 409.

Once the threshold voltage level is reached or exceeded, a light emitting diode 411 is turned on and maintained in an on state until a power down. In one embodiment, the light emitting diode 411 is latched to an on state by using a latching device 460 that detects when transistor 409 switches on. In one embodiment, the latching device is a latching circuit. In another embodiment, the latching device is a well-known solid-state flip-flop.

When transistor 409 is off, the output terminal 466 of the latching device 460 is off. When transistor 409 switches on, transistor 409 connects terminal 462 of the latching device 460 through diode 410 to the common line 402 of the power supply causing terminal 466 of the latching device 460 to latch on. When latched on, terminal 466 of the latching device 460 connects the +5V line 401 to the resistor 412. Resistor 412 is connected in series with a light emitting diode 411. When terminal 466 of latching device 460 turns on, terminal 466 causes the light emitting diode 411 to light. Resistor 412 serves to limit the current to the light emitting diode 411. The light emitting diode 411 remains lit until the power source is removed from lines 401 and 402.

As an example of specific electrical and electronic components for constructing the circuitry of an embodiment in accordance with the circuit in FIG. 3 and designating the same in nomenclature well known and readily identifiable by those skilled in the art, the diode 405 and the transistor 406 can be integrated unit FAIRCHILD QRB1113. Similarly, the resistor 404 can be a 150-ohm 0.25-watt resistor, and the capacitor 403 can be a 4.7 MFD capacitor. The resistor 407 can be a 15,000 ohm 0.25 watt resistor, the capacitor 408 a 0.1 MFD capacitor, the transistor 409 an NPN transistor, and the solid state flip-flop 460 a ITE 7472. Finally, the resistor 412 can be a 1,000-ohm 0.25-watt resistor and the light emitting diode can be a FAIRCHILD MV5025A diode. However, these examples are only examples and are not intended to limit resistor to specific resistance. One of ordinary skill in the art will recognize a wide range of different types of resistors that may be used in the circuit 400.

Figure 5:
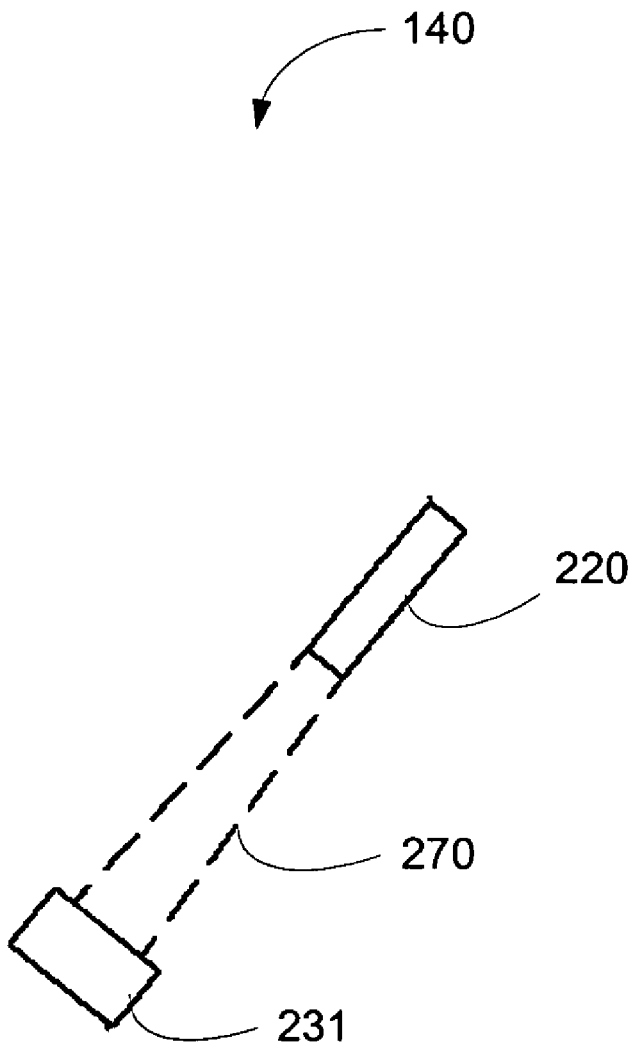
FIG. 5 illustrates a lint detector that detects lint based on the amount of light obstructed by the presence of lint.

FIG. 5 illustrates the lint detector 140 that detects lint 290 based on the amount of light obstructed by the presence of lint 290. The light source 220 focuses light 270 directly onto the photocell 231. If lint blocks the light path of the light source 270, the photovoltaic output of the photocell 231 reduces to a threshold that would indicate the presence of lint 290. The light path of the light source 270 can be blocked when lint adheres to the light source 270 or to the photocell 231. In another embodiment, if the photocell detects a light level lower than the threshold, a warning light is activated. In another embodiment, the clothes dryer is shut down when the light level falls beneath the threshold.

Figure 6:
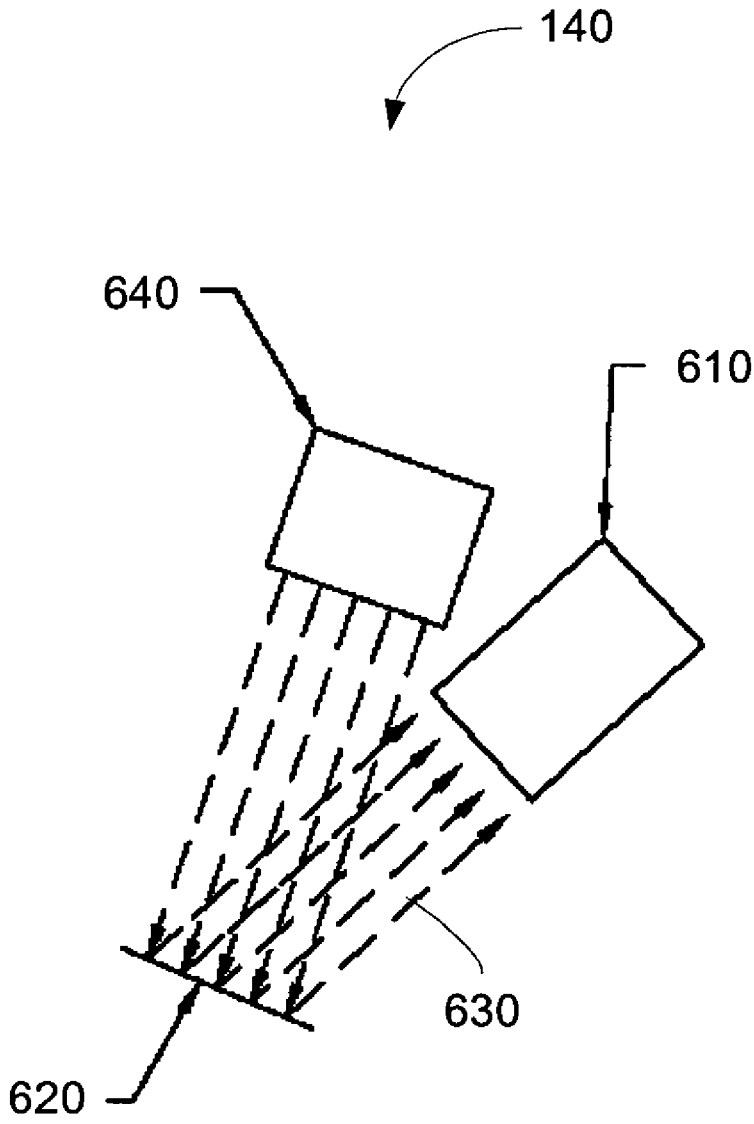
FIG. 6 illustrates a lint detector detecting lint based on spectrometry.

FIG. 6 illustrates a lint detector 140 detecting lint 290 based on spectrometry. In one embodiment, a light source 640 focuses light on a reflecting plate 620. A spectrometer 610 is calibrated to receive a specific light spectrum 630 from a reflecting plate 620. As lint adheres to the reflecting plate 620, the change of color spectrum of the reflecting plate 620 is sensed by the spectrometer 610. The change of color spectrum sensed by the spectrometer 610 can indicate the presence of lint 290. An indication of the presence of lint can then be provided or, alternatively, the clothes dryer can be shut down.

In another embodiment, the reflecting plate 620 is chemically treated and changes color as a result of lint 290 landing on the reflecting plate 620. The spectrometer 610 is calibrated so as to only recognize the spectrum color when lint 290 is not present. Once lint 290 adheres to the surface, the reflecting plate changes color and the spectrometer 610 detects the change in spectrum color. The change in spectrum color can indicate the presence of lint 290. If lint is detected a warning light can be activated, or alternatively, the clothes dryer can be shut down.

Figure 7:
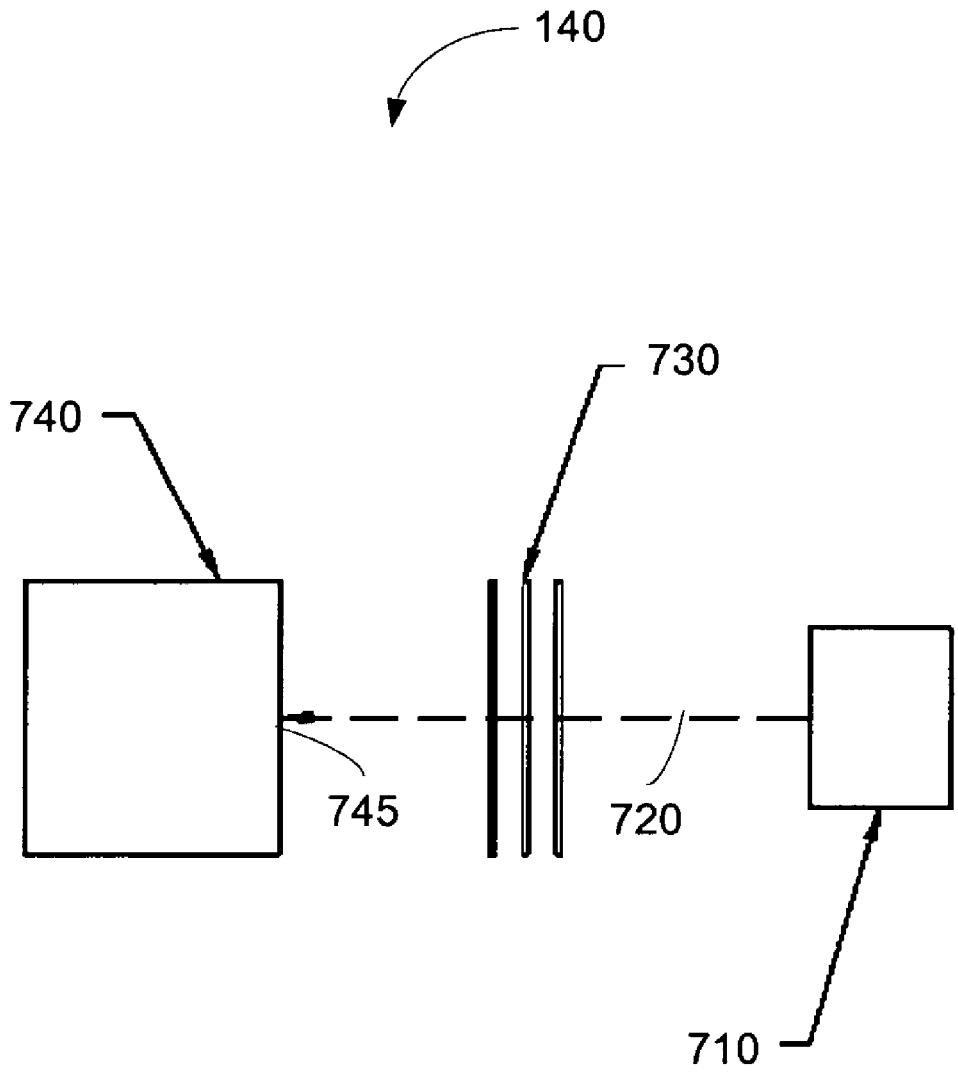
FIG. 7 illustrates a lint detector detecting lint based on laser beam dispersion.

FIG. 7 illustrates a lint detector 140 detecting lint 290 based on laser beam dispersion. In one embodiment, a light source 710 projects a laser beam focusing the laser beam on a charge-coupled device (CCD) camera 740. Before arriving to the CCD camera 740, the laser beam 720 is projected through one or more lenses 730. The CCD camera 740 is calibrated to receive a certain amount of photonic energy when lint 290 is not present. When lint adheres to the CCD camera lens 745, to the lenses 730, or to the light source 710, the amount of photonic energy decreases. The change in the amount of photonic energy can indicate the presence of lint 290. In one embodiment, a lower energy level indicates the presence of lint. Upon detecting lint, a warning light can be activated, or alternatively, the clothes dryer can be shut down.

Figure 8:
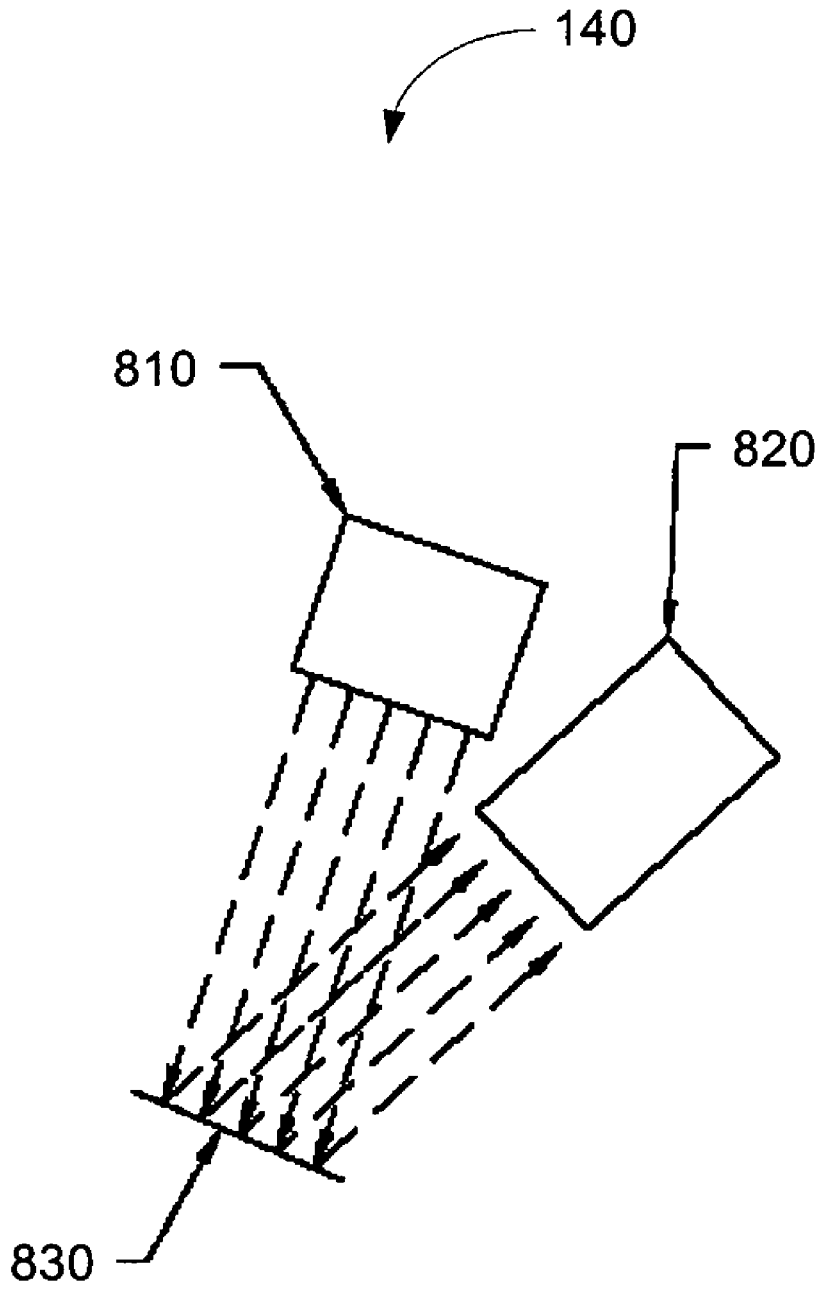
FIG. 8 illustrates a lint detector detecting lint based on thermal emissivity.

FIG. 8 illustrates a lint detector 140 detecting lint 290 based on thermal emissivity. In one embodiment, a light source 810 is focused on a plate 830. A reflectometer 820 is calibrated to the specific thermal emissivity of plate 803. When lint 290 adheres to the plate 830, the thermal emissivity of the plate 830 changes and the reflectometer 820 senses the change in thermal emission. The change in the amount of thermal emission can indicate the presence of lint 290. If lint is detected a warning light can be activated, or alternatively, the clothes dryer can be shut down.

Figure 9:
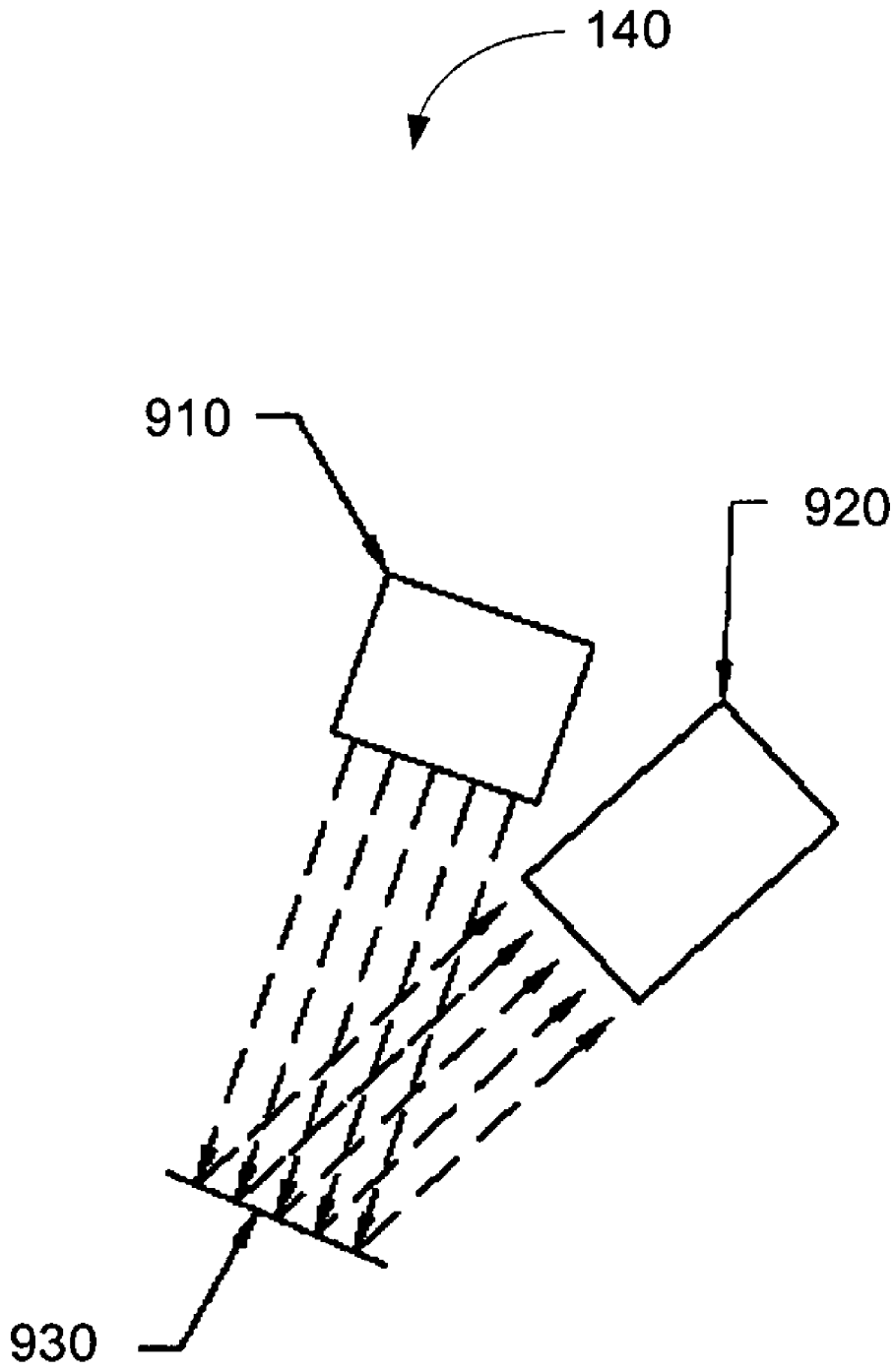
FIG. 9 illustrates a lint detector detecting lint based on fluorescence.

FIG. 9 illustrates a lint detector 140 detecting lint 290 based on fluorescence. In one embodiment, a black light source 910 is focused on a collector plate 930. A photocell 920 senses the amount of light reflected from a collector plate 930. In the absence of lint 290, no light is reflected to the photocell 920 from the collector plate 930. As lint adheres to the collector plate 930, the black light fluoresces on the lint and reflects to the photocell 920. The photocell 920 detects the light reflected off the lint 290, indicating the presence of lint 290. Once lint is detected, a warning light can be activated or the clothes dryer can be shut down.

In another embodiment, the collector plate 930 is chemically treated so as to change color as a result of adhering lint 290. Once lint 290 adheres to the collector plate 930, the collector plate 930 changes color to a fluorescent color and the photocell 290 detects the light reflected off the collector plate 930. The change in color in the collector plate 930 can indicate the presence of lint 290. If lint is detected a warning light can be activated, or alternatively, the clothes dryer can be shut down.

Figure 10:
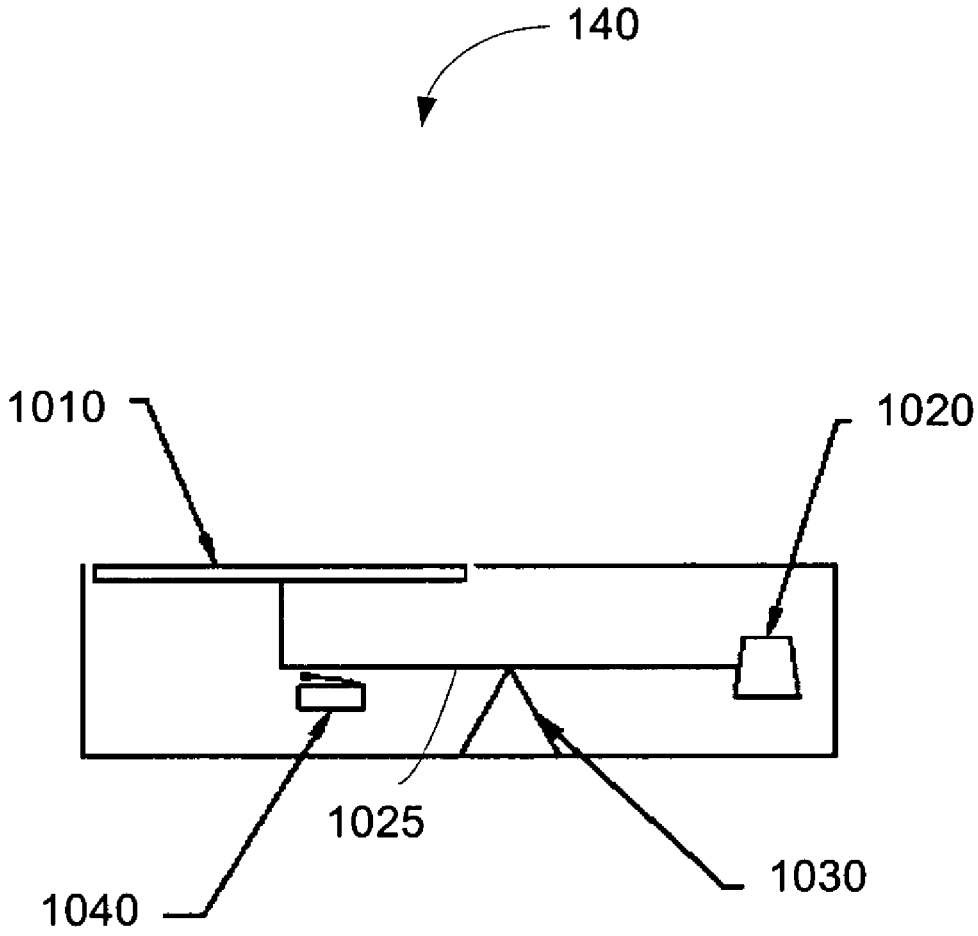
FIG. 10 illustrates a lint detector detecting lint based on lint weight.

FIG. 10 illustrates a lint detector 140 detecting lint 290 based on lint weight. In one embodiment, a collector plate 1010 rests on one side of a balance beam 1025 positioned on a pivot 1030. The collector plate 1010 is counterbalanced by a weight 1020 such that prevents the plate from closing a switch 1040. In another embodiment, the collector plate 1010 is counterbalanced by a spring. Once lint lands on the collector plate 1010, the weight of the lint increases the weight of the collector plate 1010. When a sufficient amount of lint 290 lands on the collector plate 1010 the collector plate 1010 moves downwards causing the switch 1040 to turn on. The change in weight turns the switch on indicating the presence of lint 290. If lint is detected a warning light can be activated, or alternatively, the clothes dryer can be shut down. In another embodiment, the switch 1040 can be connected to a detection circuit that filters out momentary changes or movements as a result of vibration of the balance beam 1030.

Figure 11:
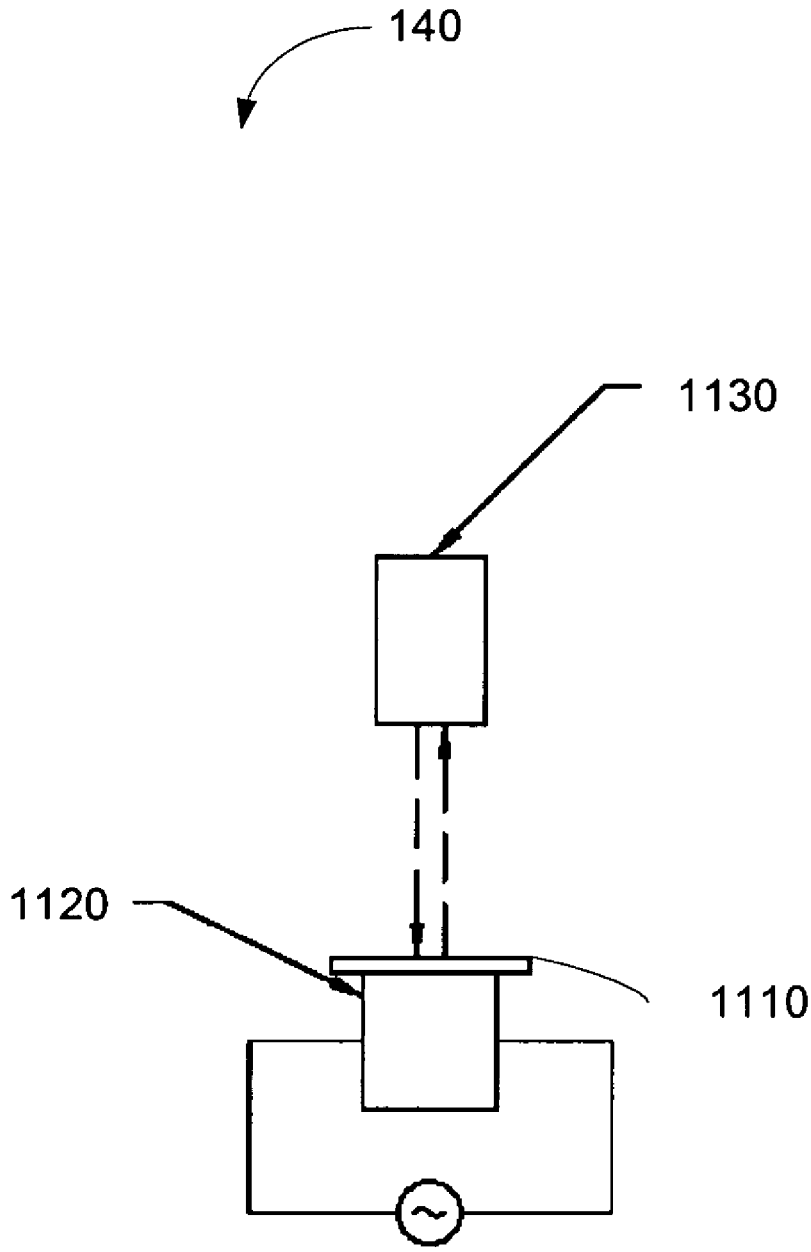
FIG. 11 illustrates a lint detector detecting lint based on vibration frequency of a wire or a plate.

FIG. 11 illustrates a lint detector 140 detecting lint 290 based on vibration frequency of a wire or a plate. In one embodiment, an electrical oscillator 1120 vibrates a collector plate 1110. A vibrometer 1130 is connected to the collector plate 1110, and is calibrated to sense the frequency at which the electrical oscillator 1120 vibrates the collector plate 1110. As lint 290 adheres to the collector plate 1110, the change in frequency is detected by the vibrometer 1130. The change in frequency can indicate the presence of lint 290. If lint is detected a warning light can be activated, or alternatively, the clothes dryer can be shut down. In one embodiment, the vibrometer 1130 is a laser vibrometer. In another embodiment, the electrical oscillator 1120 is a vibrating piezoelectric actuator.

In another embodiment, a lint detector 140 may include a vibrometer that measures the change of ultrasonic frequency of the chassis of the dryer. In the absence of lint on the clothes dryer chassis, the frequency of the vibration of the chassis of the dryer is measured and recorded. Subsequently, an ultrasonic vibration device periodically excites the clothes dryer chassis and the resulting frequency is compared to the recorded frequency. A comparator or sensing circuit measures the change in frequency. A threshold change in frequency can indicate the presence of lint 290. If lint is detected a warning light can be activated, or alternatively, the clothes dryer can be shut down.

In another embodiment, a lint detector 140 can include a sensor circuit detecting the change in capacitance. An open capacitor includes a plurality of plates connected to a sensing circuit that detects a change in capacitance between the plates. When lint falls on or in between the plates, the sensing circuit detects the change in capacitance. The change in capacitance can indicate the presence of lint 290. If lint is detected a warning light can be activated, or alternatively, the clothes dryer can be shut down.

Figure 12:
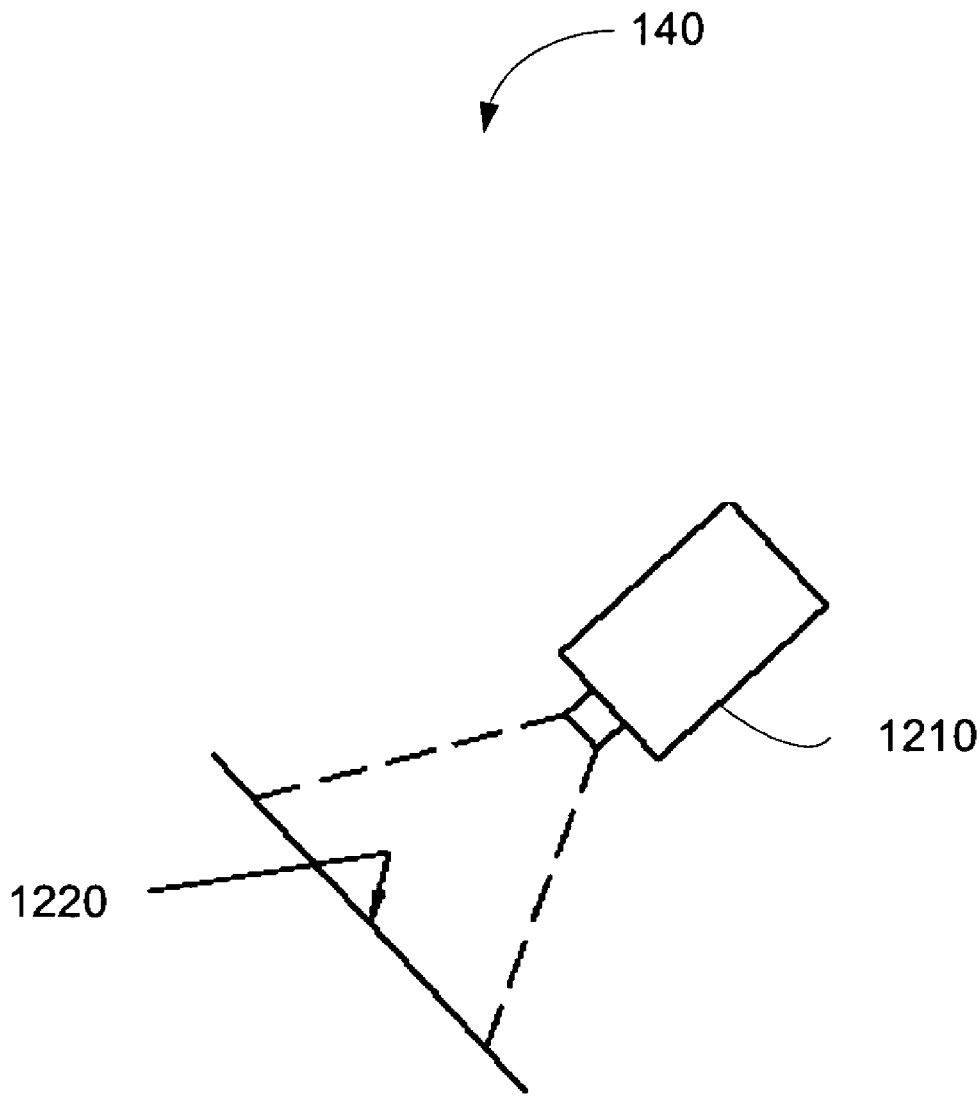
FIG. 12 illustrates a lint detector that detects lint based on pattern recognition technology.

FIG. 12 illustrates a lint detector 140 that detects lint 290 based on pattern recognition technology. In one embodiment, a pattern recognition camera 1210 is calibrated to focus on a specific target such as a sharp pattern on a surface 1220. In another embodiment, the surface 1220 is positioned within the clothes dryer. As lint 290 adheres to the surface 1220, the pattern on the surface is disrupted causing the pattern recognition camera 1210 to sense the change in the features of the pattern. The disruption of the pattern can indicate the presence of lint 290. An indication of the presence of lint can then be provided or alternatively, the clothes dryer can be shut down.

In another embodiment, the surface 1220 is a chemically treated surface that changes color as a result of adhering lint 290. The pattern recognition camera 1210 is calibrated so as to only recognize the pattern color when lint 290 is not present. Once lint 290 adheres to the surface, the surface changes color and the pattern recognition camera 1210 detects the change in pattern color. The change in pattern color can indicate the presence of lint 290. If lint is detected a warning light can be activated, or alternatively, the clothes dryer can be shut down.

In another embodiment, a lint detector 140 can include a sensor circuit detecting the change in impedance. A grid of wires separated by a certain distance is connected to a detector circuit that senses the impedance between the two adjacent wires in the grid. When lint falls in between the wires, the impedance between the wires changes. The change of impedance can indicate the presence of lint 290. Once lint is detected a warning light can be activated, or alternatively, the clothes dryer can be shut down.

In another embodiment, a collector plate or a wire being used to detect lint can attract a greater amount of lint by using an electrostatic charge. The collector plate or wire can be connected to a high voltage source. Once an electrostatic charge is applied to the plate or wire, the lint surrounding the area where the collector plate or wire is located is attracted by potential energy.

In yet another embodiment, a lint detector 140 can include a smoke detector. In the case where the presence of lint starts a fire within the clothes dryer, the smoke detector can immediately indicate the presence of a fire. If fire is detected a warning light can be activated, an audio signal can be emitted, or alternatively, the clothes dryer can be shut down.

While the above description contains many specifics, these should not be construed as limitations on the scope of the disclosure, but rather as an exemplification of preferred embodiments thereof. The disclosure includes any combination or subcombination of the elements from the different species and/or embodiments disclosed herein. One skilled in the art will recognize that these features, and thus the scope of this disclosure, should be interpreted in light of the following claims and any equivalents thereto.

We claim:

1. A lint detector positioned within a clothes dryer, comprising:

a surface through which light travels, the light being emitted by a light source positioned within the clothes dryer; and a photocell that receives light reflected from the surface if lint covers the surface.

2. The lint detector of claim 1, wherein the photocell is a phototransistor.

3. The lint detector of claim 1, fiber comprising a voltage level detector that determines if a threshold amount of light is received.

4. The lint detector of claim 3, further comprising a warning light that turns on if the threshold amount of light is received.

5. The lint detector of claim 3, further comprising an audio speaker that provides an audio signal if the threshold amount of light is received.

6. The lint detector of claim 3, further comprising an electrical output that indicates if the threshold amount of light is received.

7. The lint detector of claim 3, wherein the clothes dryer is automatically shut down if a threshold amount of light is received.

8. The lint detector of claim 1, wherein the light source is a light emitting diode.

9. The lint detector of claim 1, wherein the light source is an incandescent bulb.

10. The lint detector of claim 1, wherein the light source emits a laser beam.

11. The lint detector of claim 1, wherein the light source emits an infrared light.

12. A lint detector positioned within a clothes dryer, comprising:

a light source positioned within a clothes dryer, the light source emitting a predetermined amount of light;

a photocell that receives the predetermined amount of light from the light source, and a threshold indicator that determines the presence of lint if the photocell does not receive the predetermined amount of light.

13. The lint detector of claim 12, wherein the photocell does not receive the predetermined amount of light because lint covers the photocell.

14. The lint detector of claim 12, wherein the photocell does not receive the predetermined amount of light because lint covers the light source.

15. The lint detector of claim 12, wherein the photocell does not receive the predetermined amount of light because lint interrupts a path of the light from the light source to the photocell.

16. A lint detector positioned within a clothes dryer, comprising:

a light source positioned within a clothes dryer, the light source emitting a predetermined amount of light;

a photocell that receives the predetermined amount of light from the light source, and a threshold indicator that determines the presence of lint if the photocell receives an insufficient amount of light in comparison with the predetermined amount of light.

17. The lint detector of claim 16, wherein the photocell receives the insufficient amount of light because lint covers the photocell.

18. The lint detector of claim 16, wherein the photocell receives the insufficient amount of light because lint covers the light source.

19. The lint detector of claim 16, wherein the photocell receives the insufficient amount of light because lint interrupts a path of the light from the light source to the photocell.

20. The lint detector of claim 16, wherein the photocell is a phototransistor.

21. The lint detector of claim 16, wherein the photocell is a photoresistor.

22. The lint detector of claim 16, further comprising a warning light that turns on if the threshold indicator determines that lint is present.

23. The lint detector of claim 16, further comprising an audio speaker that provides an audio signal if the threshold indicator determines that lint is present.

24. The lint detector of claim 16, further comprising an electrical output that indicates if the threshold indicator determines that lint is present.

25. The lint detector of claim 16, wherein the clothes dryer is automatically shirt down if the threshold indicator determines that lint is present.

26. The lint detector of claim 16, wherein the light source is a light emitting diode.

27. The lint detector of claim 16, wherein the light source is an incandescent bulb.

28. The lint detector of claim 16, wherein the light source emits a laser beam.

29. The lint detector of claim 16, wherein the light source emits an infrared light.

30. A lint detector positioned within a clothes dryer, comprising:

a photocell that receives a predetermined amount of light from a light source, wherein the light source is positioned within the clothes dryer; and, a threshold indicator that determines the presence of lint if the photocell receives an insufficient amount of light in comparison with the predetermined amount of light.

31. The lint detector claim 1, wherein the photocell is a photoresistor.

32. The lint detector claim 1, wherein the surface is transparent.

33. The lint detector claim 1, wherein the surface is non-reflective.

* * * * *